US012291949B2

(12) United States Patent
Stewart

(10) Patent No.: US 12,291,949 B2
(45) Date of Patent: May 6, 2025

(54) FLUID LIFT SYSTEM

(71) Applicant: Allied H2O, Inc., Arcadia, OK (US)

(72) Inventor: Stephen Paul Stewart, Luther, OK (US)

(73) Assignee: ALLIED H2O, INC., Arcadia, OK (US)

( * ) Notice: Subject to any disclaimer, the term of this patent is extended or adjusted under 35 U.S.C. 154(b) by 0 days.

(21) Appl. No.: 18/777,225

(22) Filed: Jul. 18, 2024

(65) Prior Publication Data

US 2025/0027394 A1 Jan. 23, 2025

Related U.S. Application Data

(60) Provisional application No. 63/527,962, filed on Jul. 20, 2023.

(51) Int. Cl.
*E21B 43/12* (2006.01)
*F04D 13/02* (2006.01)
*F04D 29/046* (2006.01)

(52) U.S. Cl.
CPC ..... *E21B 43/126* (2013.01); *F04D 13/028* (2013.01); *F04D 29/046* (2013.01)

(58) Field of Classification Search
CPC ..... E21B 43/121; E21B 43/126; F04B 47/02
See application file for complete search history.

(56) References Cited

U.S. PATENT DOCUMENTS 3,489,035 A * 1/1970 Giles ..... F16H 47/04 60/447
4,291,588 A 9/1981 Justice
4,345,884 A 8/1982 Longiny et al.
4,475,872 A 10/1984 Foughty
5,746,582 A * 5/1998 Patterson ..... E21B 43/128 418/48
5,960,886 A 10/1999 Morrow
5,993,169 A 11/1999 Adachi et al.
6,063,001 A * 5/2000 Suhling ..... E21B 43/121 417/424.2
6,440,033 B1 8/2002 Suhling et al.
6,454,010 B1 * 9/2002 Thomas ..... E21B 43/129 417/423.6
8,016,027 B2 9/2011 Boyles
9,169,694 B2 10/2015 Winslow
10,428,628 B2 10/2019 Markovitch et al.
10,883,488 B1 1/2021 Oman et al.
(Continued)

FOREIGN PATENT DOCUMENTS

WO 2017158573 A1 9/2017

OTHER PUBLICATIONS

National Pump Company, "Vertical Turbine Pumps", Installation, Maintenance & Operation Instruction Manual, accessed via https://www.nationalpumpcompany.com/wp-content/uploads/2017/02/VTP-IOM-3-20.pdf on Feb. 27, 2023, pp. 1-72.
(Continued)

*Primary Examiner* — Justin D Seabe
*Assistant Examiner* — Jackson N Gillenwaters
(74) *Attorney, Agent, or Firm* — McAfee & Taft

(57) ABSTRACT

A lift system for pumping fluid from a well has a drive mechanism, a submersible pump, a gear assembly, and input and output shafts rotated by the drive mechanism extending through and into the pump.

20 Claims, 12 Drawing Sheets

(56) References Cited

U.S. PATENT DOCUMENTS

| | | | | |
|---|---|---|---|---|
| 11,208,999 | B2 | 12/2021 | Straub et al. | |
| 2003/0155113 | A1 | 8/2003 | Mitchell et al. | |
| 2003/0196802 | A1* | 10/2003 | Proctor | E21B 43/38 166/265 |
| 2007/0215343 | A1* | 9/2007 | McDonald | H02K 49/102 166/105 |
| 2008/0058146 | A1* | 3/2008 | Pizzichil | F04D 13/022 475/72 |
| 2009/0142207 | A1 | 6/2009 | Ring et al. | |
| 2014/0224063 | A1 | 8/2014 | Alford et al. | |
| 2021/0320549 | A1 | 10/2021 | Sheth et al. | |
| 2022/0178376 | A1 | 6/2022 | Ekambaram et al. | |

OTHER PUBLICATIONS

Yan, Wenhui et al., "Transmission mechanism analysis of downhole drive reciprocating pump production system based on rack and pinion", Journal of Physics: Conference Series, 2019, pp. 1-9.

International Search Report and Written Opinion mailed Oct. 9, 2024 in corresponding PCT Application No. PCT/US2024/038584, pp. 1-14.

* cited by examiner

FLUID LIFT SYSTEM

CROSS REFERENCE TO RELATED APPLICATION

The present application claims priority to U.S. Provisional Application No. 63/527,962 filed on Jul. 20, 2023, the entirety of which is hereby incorporated by reference.

FIELD

The field relates to fluid lift systems for lifting fluid from below the earth's surface.

DESCRIPTION OF AN EMBODIMENT

Figure 1A:
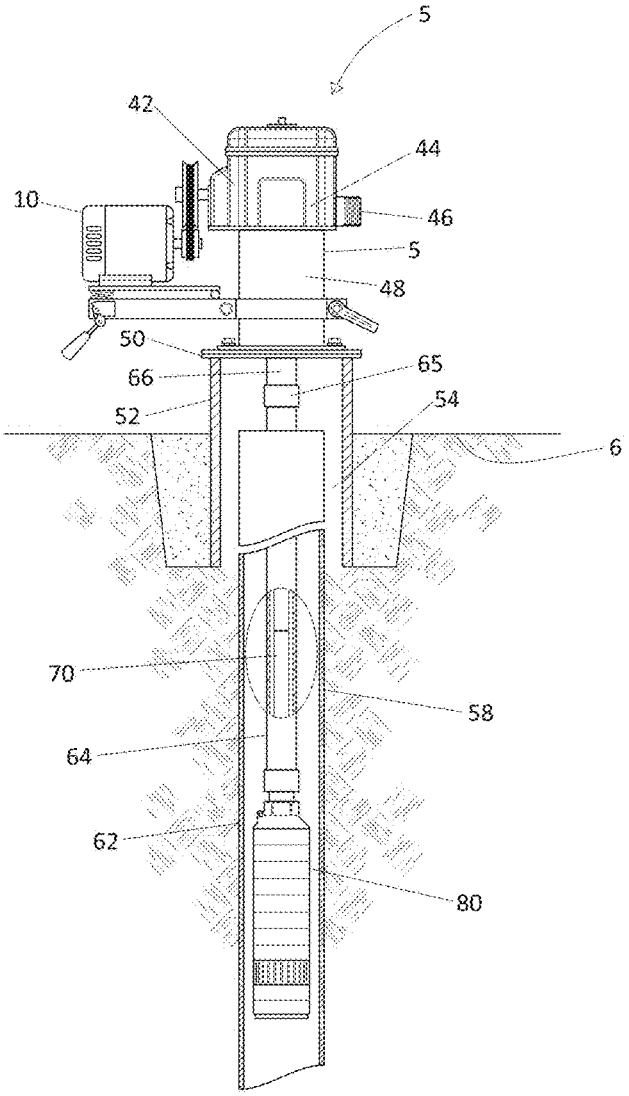
FIG. 1*a* is a schematic showing a fluid lift system with a downhole pump and an electric motor.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features may be shown exaggerated in scale or in somewhat schematic form and some details of conventional elements may not be shown in the interest of clarity and conciseness. Specific embodiments are described in detail and are shown in the drawings, with the understanding that the present disclosure is not intended to be limited to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition. The use of the term "at least one" or "one or more" will be understood to include one as well as any quantity more than one.

Referring now to FIG. 1*a*, a lift system 5 for lifting water or other fluid from beneath the surface of the earth 6 is shown. In the embodiment of FIG. 1*a*, the lift system 5 is operated by an electric motor 10. Power for operating the lift system may be derived from any available source. For example, power may be generated by solar panel system 15, a generator 20 of a type known in the art, an electric grid 25 or a gasoline engine 30. The power source, for example the gasoline engine 30, may be supported on a movable base 31.

Water produced by the lift system 5 may be delivered to any needed area. For example, water produced may be delivered to a sprinkler system 32, through a hose 34 to furrowed agricultural areas or to an elevated storage tank 36 for later use. The lift system 5 is designed for use in shallow wells, typically about seventy-five (75) feet or less, but can be used in deeper wells. Lift system 5 provides an economic and efficient alternative for producing water, particularly in underdeveloped countries. The lift system 5 can operate in areas where no electric grid exists, and because the power source is above ground can use any number of power sources. The lift system can deliver as much as twelve cubic meters of water per seven-hour solar day, using a solar powered engine, which in one example may be a solar powered DC motor. The daily capacity is much greater when using power sources other than solar. Much of the lift system 5 can be constructed with polyvinylchloride (PVC) which is a lightweight, readily available inexpensive material.

Electric motor 10 may be connected to transmission gearbox 42 that will provide rotation to a drive shaft as explained below. Lift system 5 includes a water tank 44 for receiving water lifted from below the surface and an output, or discharge pipe 46 communicated therewith. A wellhead transition pipe 48 is connected to water tank 44 and is supported on a platform 50. A wellhead pipe 52 is cemented into a bore 54 and supports platform 50. A casing 62 is positioned in a wellbore 58 and may be backfilled therein. A rising main 64 is coupled with a coupler 65 to a downspout 66 that communicates water lifted by the lift system 5 into water tank 44 and discharge pipe 46.

A drive shaft 70, which may comprise upper and lower drive shaft segments 72 and 74, is disposed in rising main 64. Drive shaft 70 extends downwardly from the surface into rising main 64 and is rotated by electric motor 10 through transmission gear box 42 or other known means. Pump assembly 80 is connected to rising main 64 at the lower end thereof. Pump assembly 80 will deliver fluid upwardly through rising main 64 and out through discharge pipe 46 to a desired output source.

Figure 9:
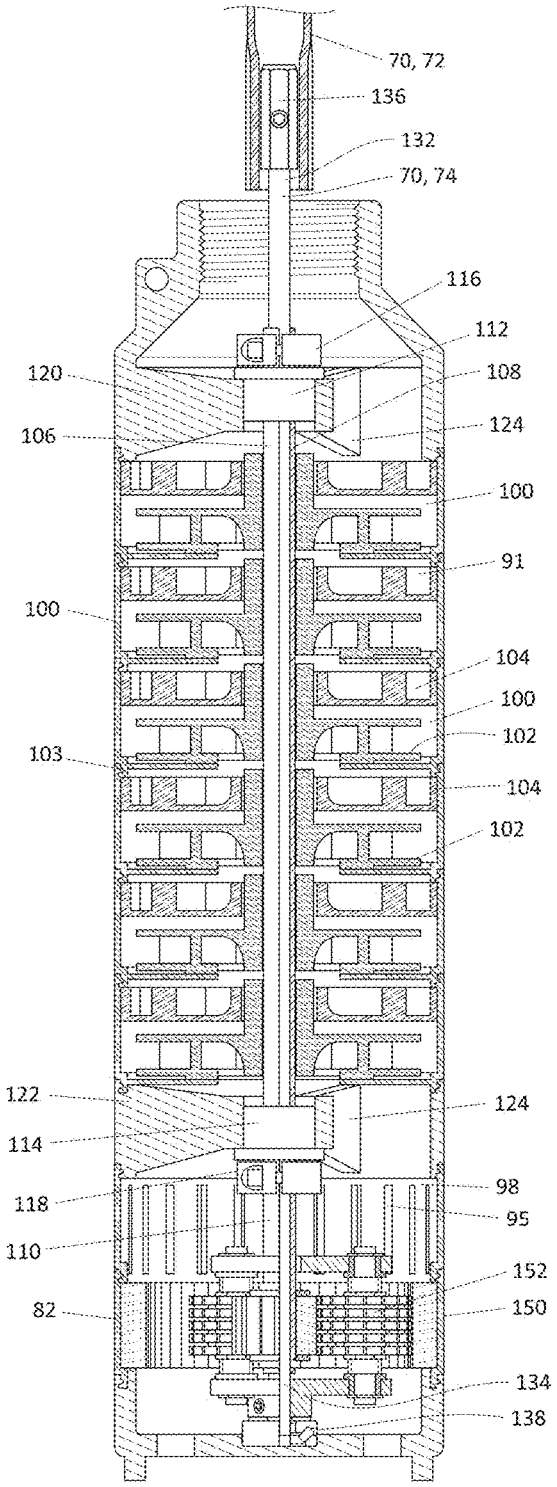
FIG. 9 is a partial cross section of the pump assembly.
Figure 9A:
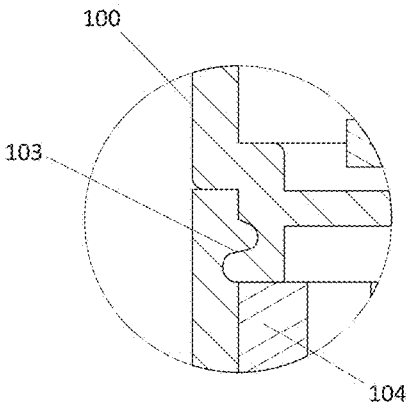
FIG. 9*a* is a close-up view of a connection between pump stages.
Figure 19A:
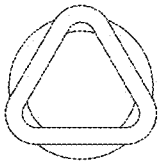
FIG. 19*a* is a view looking up at the upper portion of a drive shaft.
Figure 20:
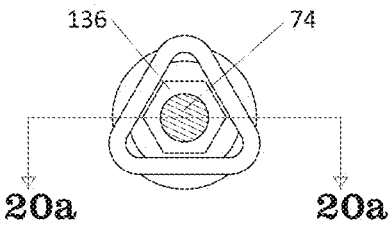
FIG. 20 is a view looking up at the lower end of the upper portion of a drive shaft, with the lower portion of the drive shaft in cross section.
Figure 19:
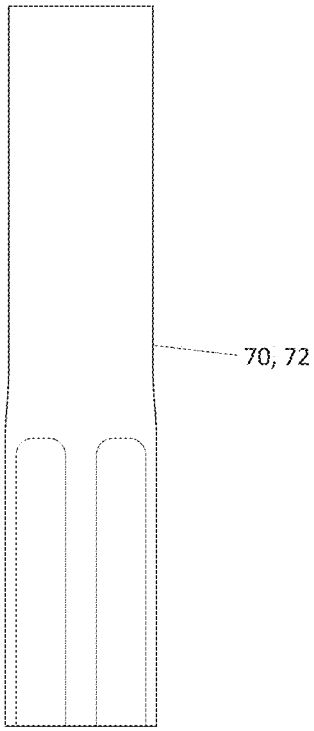
FIG. 19 is an elevation view of one embodiment of the lower end of the upper portion of a drive shaft.
Figure 20A:
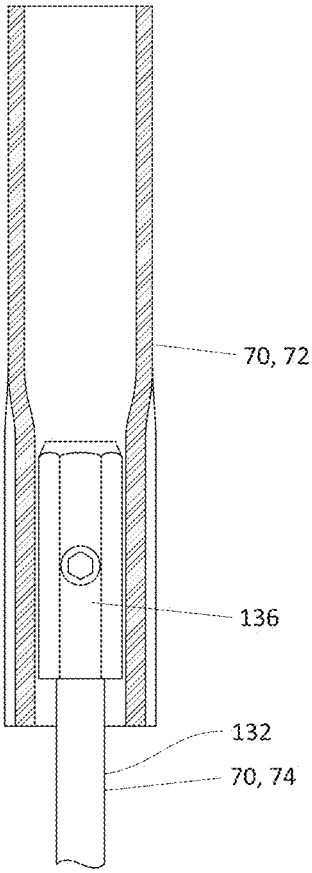
FIG. 20*a* is a cross section from 20*a*-20*a*.

A gear assembly 82 is positioned below pump assembly 80 and is connected thereto. Pump assembly 80 comprises a pump housing 90 defining a pump interior 91. Pump housing 90 includes a discharge head 92 at an upper end 94 of pump housing 90 and an intake section 96 at the lower end 98 of pump housing 90. Water or other fluid will be communicated into pump interior 91 through intake section 96 and will be discharged through discharge head 92, which is communicated with rising main 64. Pump assembly 80 comprises a plurality of pump stages 100 between discharge head 92 and intake section 96. Each pump stage comprises an impeller 102 and a diffuser 104. Pump stages 100 may be connected in a manner known in the art, such as for example with threads 103 as shown in FIG. 9*a*.

An impeller drive shaft 106 has upper end 108 and lower end 110. Impeller drive shaft 106 extends through the pump housing 90 from above the uppermost of pump stages 100 to below the lowermost of the pump stages 100. Impeller drive shaft 106 extends into gear assembly 82 and is connected thereto. Impeller drive shaft 106 is supported by upper and lower support bushings 112 and 114, which are fixed in upper and lower spider supports 120 and 122. Upper and lower spider supports 120 and 122 will have three spider legs 124 as is known in the art, only two of which are shown. Impeller drive shaft 106 in the embodiment shown is a hexagonal shaft which will rotate in support bushings 112 and 114. Support bushings 112 and 114 will have an inner diameter slightly larger than the maximum tip to tip diameter of the hex shaped impeller drive shaft 106 so that impeller drive shaft 106 will rotate therein. Upper and lower shaft collars 116 and 118 may be fixed to impeller drive shaft 106 immediately above and below support bushings 112 and 114 to provide additional support. Shaft collars 116 and 118 will rotate with impeller drive shaft 106.

Lower segment 74 of drive shaft 70 has upper end 132 and lower end 134. Upper end 132 of lower segment 74 has a drive shaft adapter 136 for connecting to upper segment 72 of drive shaft 70. The drive shaft adapter 136 may be of any type known in the art, and in the embodiment disclosed is simply an adapter over which a mating adapter with a hollow receptacle capable of transferring torque can be placed. Other connectors may be used. In the disclosed embodiment, drive shaft adapter 136 is a generally hex shaped adapter, and the lower end of upper segment 72 of drive shaft 70 has a generally triangular shaped opening to receive drive shaft adapter 136. Such an arrangement provides for the transfer of rotation and torque, and also allows for relative vertical movement between the upper and lower portions of the drive shaft 70. Because the connection is not rigid, the total weight of the upper segment 72 is not felt by lower segment 74 or by pump assembly 80. In addition, the lack of a rigid connection between the upper and lower segments 72 and 74 allows for the raising and lowering of the wellhead components during the installation process, which makes for an easier, more efficient installation process. The arrangement likewise provides for expansion and contraction of the upper segment 72 which may be made from PVC. Lower segment 74 extends through pump housing 90 and is received in a support bearing 138. Support bearing 138 may be for example a roller bearing that allows drive shaft 70 to rotate therein. A connecting collar 140 is attached to drive shaft 70, and specifically to lower segment 74, with a set screw 142 that extends through connecting collar 140 and engages drive shaft 70.

Gear assembly 82 is connected to pump assembly 80 at the lower end thereof, and is positioned below pump stages 100, and thus below the impellers 102. Gear assembly 82 comprises a gear housing 150 with a gear set 152, which in the embodiment described is a planetary gear set 152. Gear set 152 includes an upper planetary carrier 154 and a lower planetary carrier 156. Connecting collar 140 is connected to lower planetary carrier 156, so that the rotation of drive shaft 70 rotates lower planetary gear carrier 156 through connecting collar 140. Planetary gear set 152 includes planet gears 158 comprised of first, second and third planet gears 160, 162 and 164, respectively. Planetary gear set 152 has a ring gear 166 and a sun gear 168. Ring gear 166 is fixed to gear housing 150 and does not rotate.

Planet gears 158 in the described embodiment comprise a plurality of stacked sprockets 170 with sprocket spacers 172 therebetween. Sprocket spacers 172 may also be positioned at the upper and lower ends of the stacked sprockets 170. Sprockets 170 may be held together with clips or other means, for example an E-clip 189. Planet gears 158 have a generally D-shaped hub 174, through which a D-shaped shaft 176 extends. D-shaped shaft 176 has upper and lower ends 178 and 180 that are received in planetary gear bushings 182. D-shaped shaft 176 may have a generally cylindrical extension 184 at the upper and lower ends thereof received in a cylindrical portion of planetary gear bushings 182. Cylindrical extensions 184 at the upper and lower ends may be held in place with clips or other means, for example an E-clip 188. The materials to be used for the components of the gear set 152 may comprise materials sufficiently strong and resistant to withstand the downhole conditions and the rotational movement imparted thereon. In one non-limiting example, ring gear 166 and sun gear 168 may be comprised of a hard rubber material, and planetary gears 158 may comprise a steel material. Sun gear 168 has a hex-shaped opening 186 through which impeller drive shaft 106 is received.

Gear set 152 is a speed increasing gear set 152, so that the speed at which impeller drive shaft 106 rotates will be faster than the speed at which input drive shaft 70 is rotated. In one embodiment, the gear set 152 will increase the speed of impeller drive shaft 106 at a 5:1 ratio. Thus, for example, when drive shaft 70 is rotated at a speed of 500 rpm, impeller drive shaft 106 will rotate at a speed of 2500 rpm. In the embodiment described, drive shaft 70 is rotated by an electric motor 10 but it is understood that any number of power sources like those described herein can be used to rotate drive shaft 70.

In one embodiment, rising main 64 has a helical bearing disposed therein. Helical bearing 190 may be comprised of, for example, UHMW. Helical bearing 190 is disposed about drive shaft 70 and will limit the amount of vibration imparted by the drive shaft 70 on the downhole components of pump assembly 80 and the wear caused by friction imparted to the inner surface of rising main 64. Helical bearing 190 may have a length sufficient to extend along the length of the rising main 64 for a majority of the length thereof. Helical bearing 190 may have an outer diameter such that it will be compressed in order to fit in rising main 64 and will be biased radially outwardly into an inner surface of the rising main 64 so that it is held in place therein.

In operation, drive shaft 70 will be rotated by electric motor 10, and in the embodiment described will rotate in the counterclockwise direction. Rotation of drive shaft 70 will cause rotation of planet carriers 154 and 156. Planet carrier 156 is rotated by drive shaft 70, and the rotation of planet carrier 156 causes rotation of planet carrier 154 through D-shaped shaft 176. D-shaped shafts 176 will rotate as the planet gears 158 rotate. The engagement of planet gears 158 with ring gear 166 will cause planet gears 158 to rotate as the planetary gear carriers 154 and 156 rotate. The rotation of planet gears 158 will cause sun gear 168 to rotate.

Hex-shaped impeller drive shaft 106 is received in sun gear 168 and is rotated thereby. Impeller drive shaft 106 rotates in the same direction as drive shaft 70, which rotates inside impeller drive shaft 106. Rotation of impeller drive shaft 106 rotates impellers 102. The rotation of impellers 102 pulls fluid, for example water, into pump interior 91 through slots 95 in intake section 96. The fluid is pumped upwardly through rising main 64, wellhead transition pipe 48, water tank 44 and output discharge pipe 46.

In one example, the drive shaft rotates at 500 rpm, and the impeller shaft rotates at 2500 rpm. Because the shafts rotate in the same direction, the relative difference in speed is 2000 rpm, so that vibration is reduced from the typical arrangement. In addition, by utilizing the speed increasing gear arrangement on the bottom of pump assembly 80, a more compact pump can be used to achieve a flow rate that would normally require a much longer, expensive and complex pump. For example, it is known that reducing the RPM of an impeller located inside a centrifugal pump will impact the anticipated outputs of flowrate and head pressure at different levels. Flowrate will be reduced at a ratio equal to that of the speed change (i.e., RPM change of 50% will decrease the flowrate to 50% of the original specifications) and head pressure will be reduced at a ratio equal to the square of the speed change (i.e., RPM change of 50% will decrease the head pressure to 25% of the original specifications). It is also known that in a multi-stage centrifugal pump, the total head pressure of an individual stage can be calculated by dividing the total head specification by the number of stages. To achieve an increased total head capacity at reduced RPM, additional stages can be added until target head pressure is reached. Thus, if a nine-stage pump can achieve eighteen gallons per minute at 160 feet of head with a shaft rotating at 2500 rpm, it would require an 18 stage pump to achieve the same flow at 320 feet of head. If the speed of rotation is reduced to 1250 rpm, and the same flow rate is desired at 160 feet of head, a 36 stage pump would be required.

Increasing the number of stages, which greatly increases the length of the pump is costly. In addition, the more stages that exist, the greater likelihood of malfunctions and complications. Increasing the speed of rotation of the drive shaft extending from the surface increases the vibration and stress on the entire fluid lift system. By providing a fluid lift system with a speed increasing gear box that increases the speed of the impeller shaft relative to the input, or drive shaft, the lift system of the current disclosure can develop higher flow rates with fewer stages than is possible with other systems that lack the speed increasing feature. A pump end with a speed increasing planetary gearbox allows surface-powered line shaft operation to benefit from reduced RPM speeds (i.e., 500) while the pump end independently benefits from stepped-up RPM speeds (i.e., 2500) to allow for a more economical, robust, and traditional construction.

Figure 21:
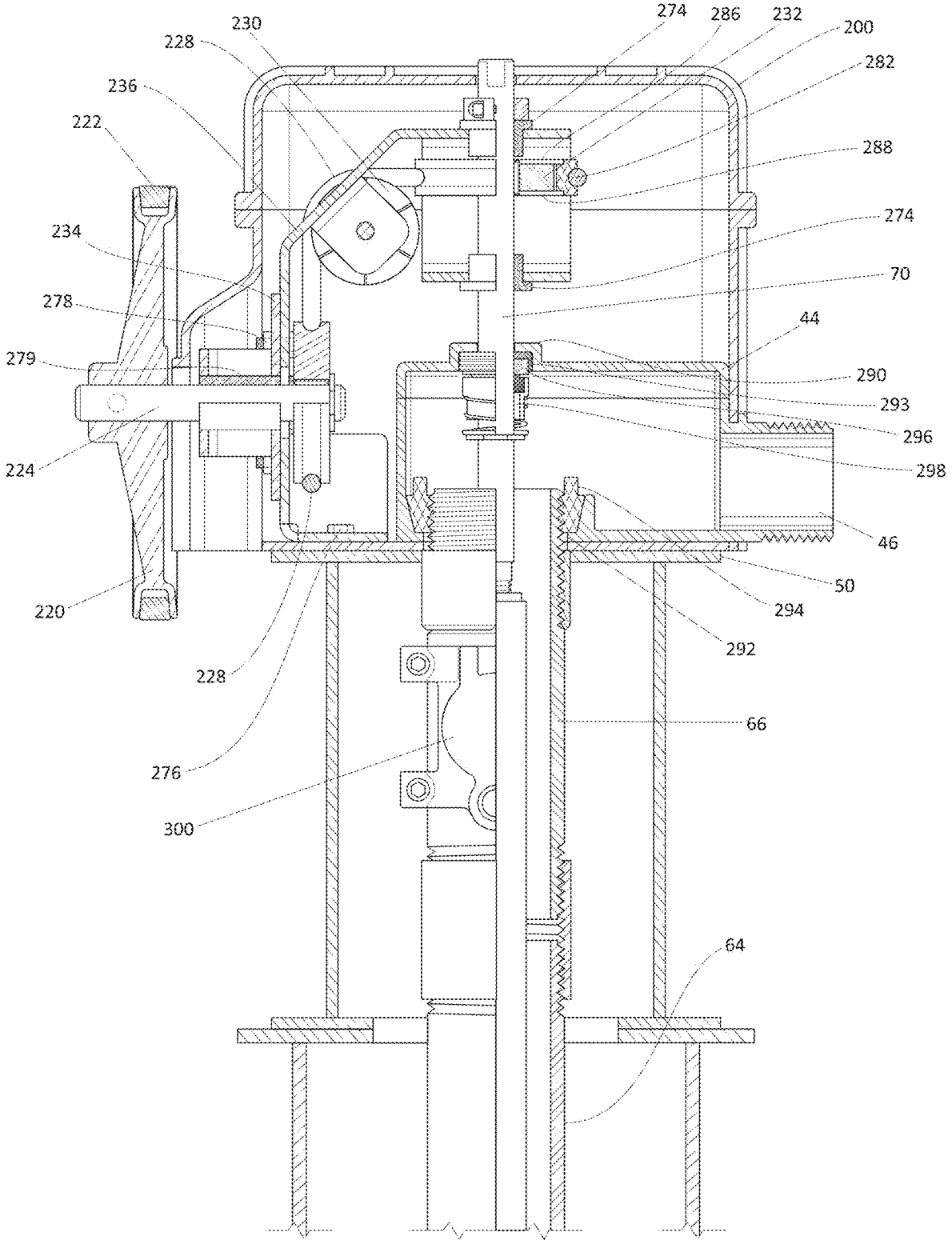
FIG. 21 shows a cross section from lines 21-21 of FIG. 1*b*.
Figure 22:
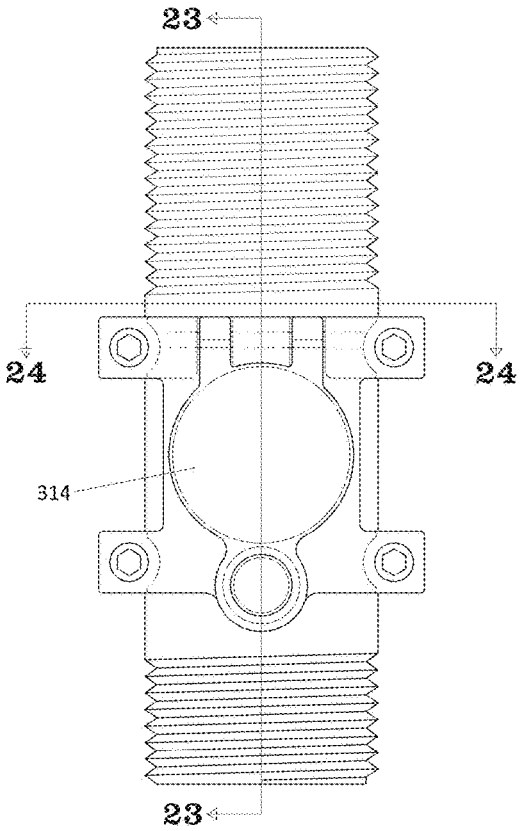
FIG. 22 is an elevation view of a relief valve that may be used with the fluid lift system.
Figure 23:
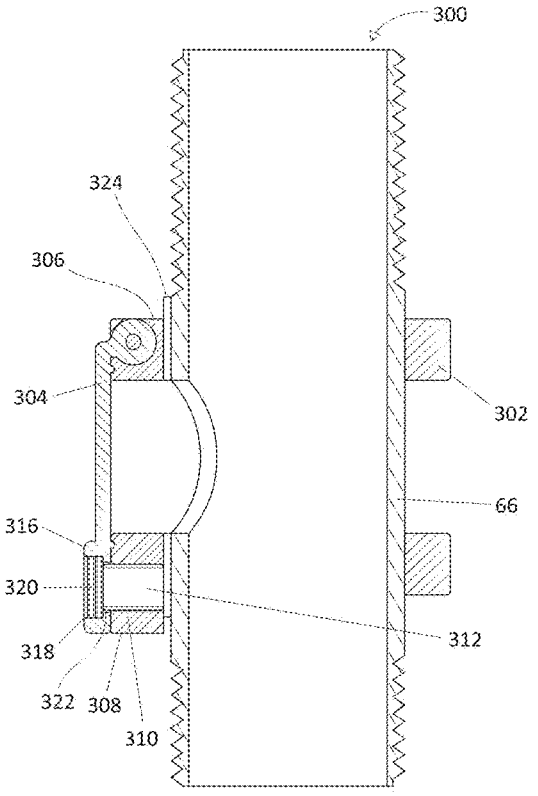
FIG. 23 is a cross section of the relief valve that may be used with the fluid lift system.
Figure 24:
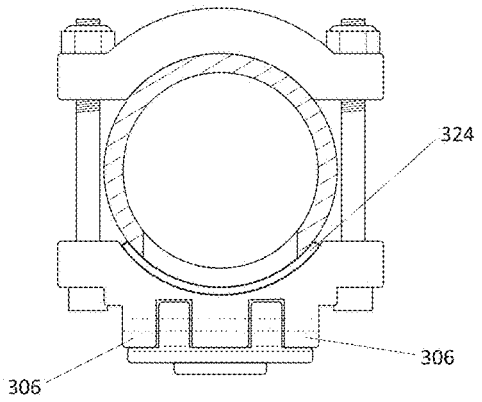
FIG. 24 is a section from line 24-24, rotated 90 degrees.
Figure 25:
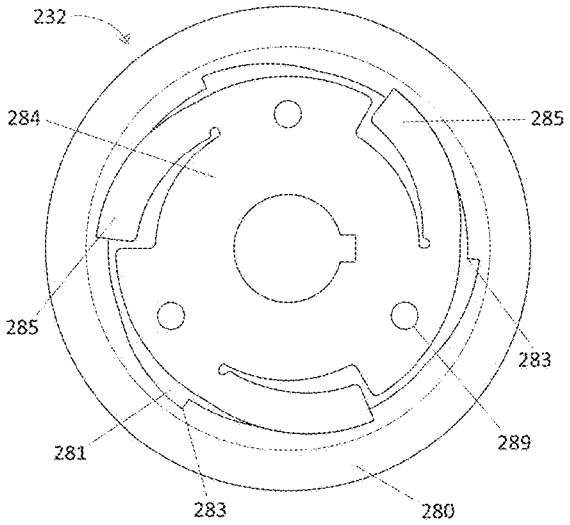
FIG. 25 is a top plan view of a gear used in the transmission of the fluid lift system.
Figure 26:
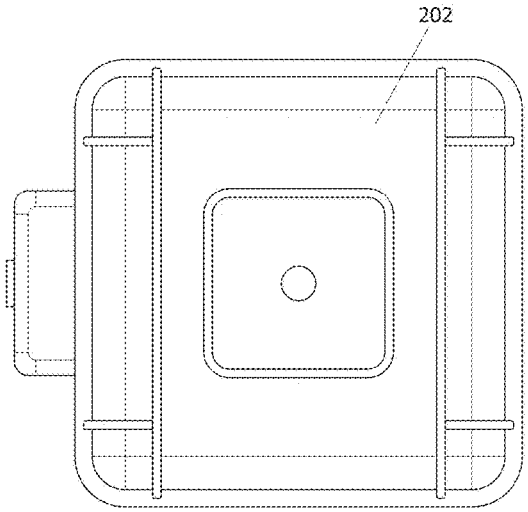
FIG. 26 is a top view of an enclosure for the transmission used with the fluid lift system.
Figure 27:
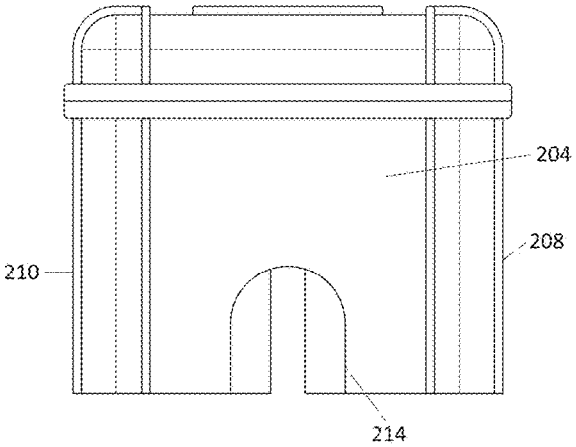
FIG. 27 is a front view of the enclosure for the transmission used with the fluid lift system.
Figure 28:
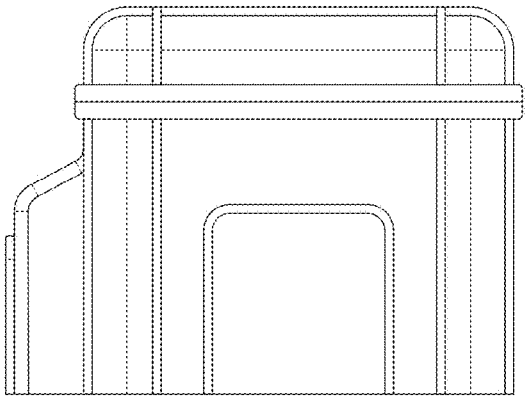
FIG. 28 is a side elevation view of the enclosure for the transmission used with the fluid lift system.
Figure 29:
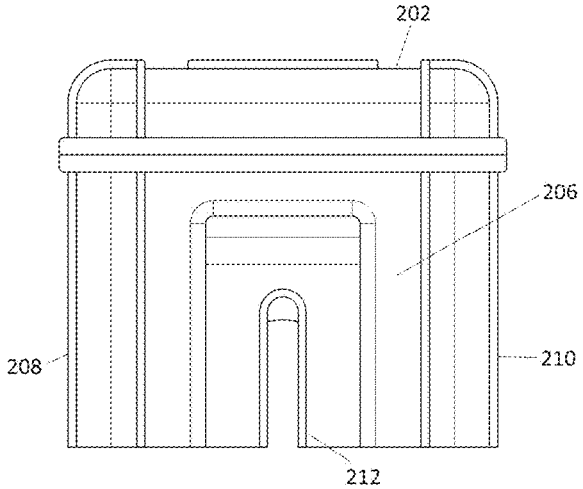
FIG. 29 is a rear view of the enclosure for the transmission used with the fluid lift system.
Figure 30:
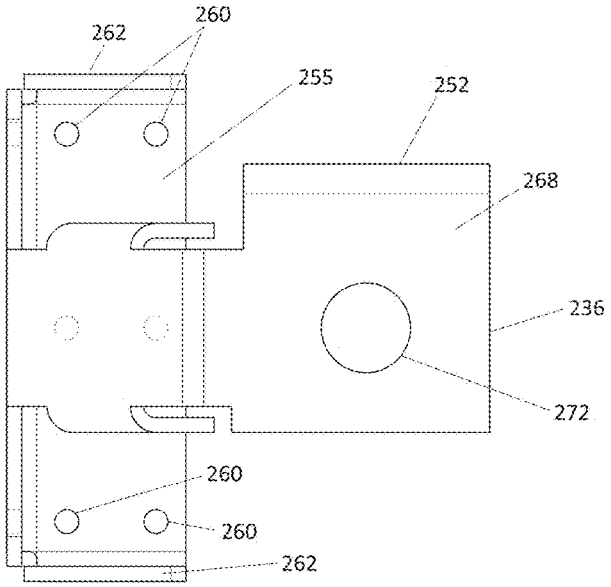
FIG. 30 is a top view of a pulley bracket used in the transmission system.
Figure 31:
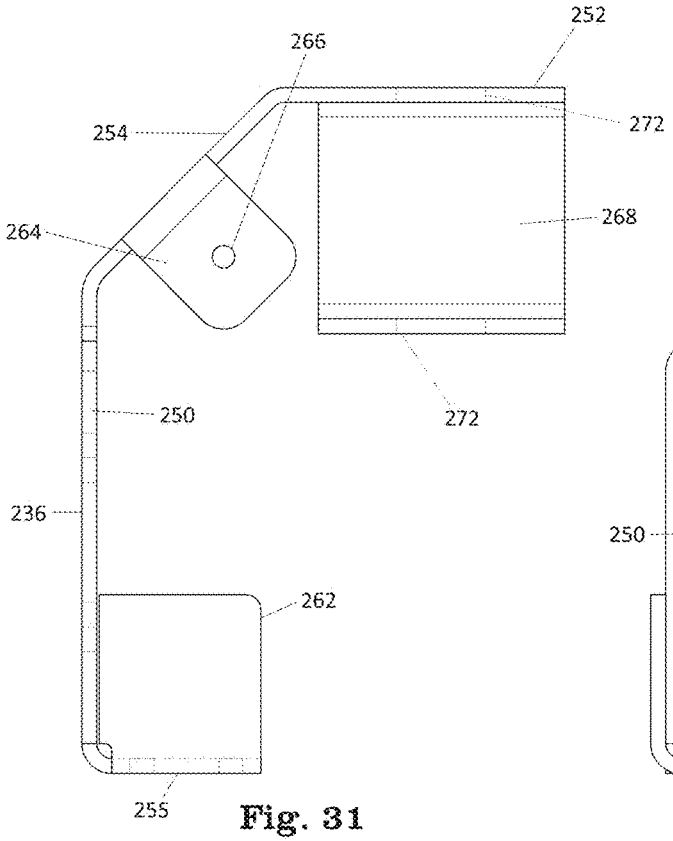
FIG. 31 is a side view of a pulley bracket used in the transmission system.
Figure 32:
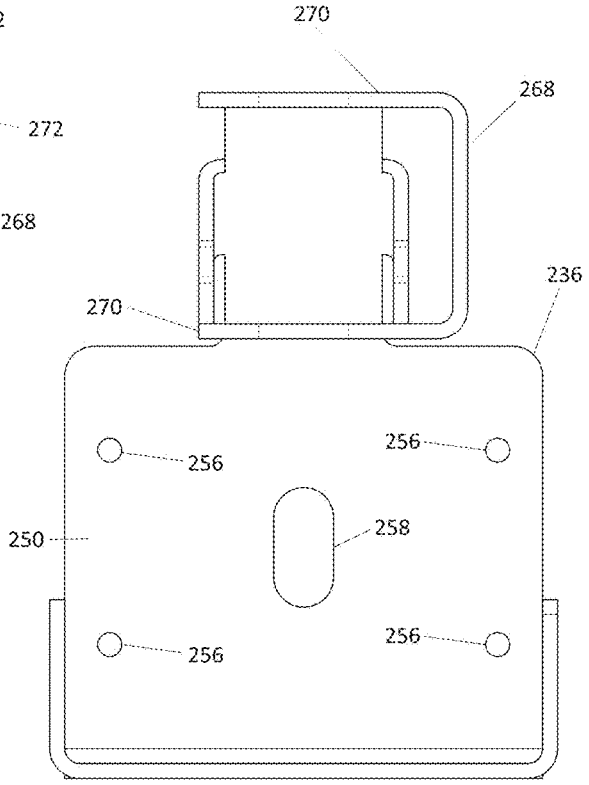
FIG. 32 is a front view of a pulley bracket used in the transmission system.
Figure 33:
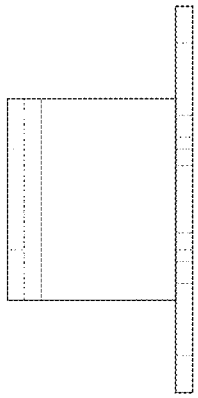
FIG. 33 is a side view of a pulley shaft bracket used in the transmission system.
Figure 34:
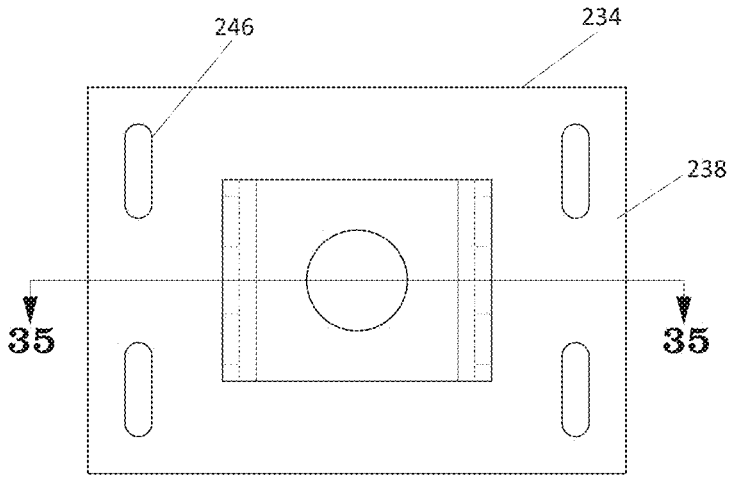
FIG. 34 is a front view of a pulley shaft bracket used in the transmission system.
Figure 35:
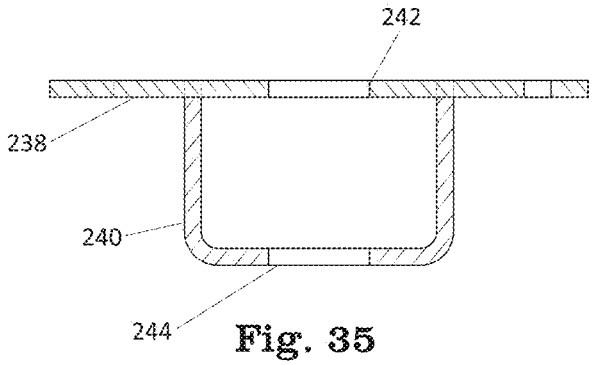
FIG. 35 is a section from line 35-35.

One embodiment of transmission gear box 42 is shown in FIG. 21. Transmission gear box 42 may have an enclosure 200 disposed thereabout. Enclosure 200 has a top panel 202, front panel 204, rear panel 206 and first and second side panels 208 and 210. Rear panel 206 has a slot 212 to allow a transmission input shaft to pass therethrough. Enclosure 200 may also cover water tank 44. Front panel 204 has an opening 214 in front panel 204 to allow discharge pipe 46 of water tank 44 to pass therethrough. The protective enclosure 200 protects the internal frame and transmission gear box 42 from weather, dust and other environmental factors and creates a safe operating environment by covering moving parts. Enclosure 200 may be made from materials known in the art and may be for example, molded from UV stable and highly resilient material, such as polypropylene and high-density polyethylene.

Referring now to FIG. 21, a drive pulley 220 is rotated by a drive belt 222 which is rotated by a power source, for example engine 30. Rotation of drive pulley 220 will generate rotation of drive shaft 70 which drives pump assembly 80 as described herein. Drive pulley 220 is rotatably connected to a main input shaft 224. Main input shaft 224 rotates vertical input pulley 226. An input belt 228 engages and is wrapped around vertical input pulley 226, idler pulley 230 and horizontal input pulley 232. Horizontal input pulley 232 is a unidirectional pulley and rotation of horizontal input pulley 232 will rotate drive shaft 70. Vertical input pulley 226, idler pulley 230 and horizonal input pulley 232 are mounted using first and second brackets 234 and 236.

First bracket 234 comprises a flat plate 238 with a U-shaped channel 240 connected thereto. Flat plate 238 and U-shaped channel 240 have openings 242 and 244 respectively to allow main input shaft 224 to pass therethrough. Flat plate 238 has slots 246 therein which will allow the tensioning of input belt 228 as more fully described below. Second bracket 236 has a rear panel 250, a top panel 252, a connecting panel 254 and a bottom panel 255. Rear panel 250 has a slot 258 to allow main input shaft 224 to pass therethrough and has fastener openings 256. Bottom panel 255 has fastener holes 260 and has cars 262 extending therefrom to provide structural support. Connecting panel 254 has tab 264 connected thereto and extending therefrom and has a pin hole 266. Idler pulley 230 is rotatably connected to tab 264. Top panel 252 has a U-shaped channel 268 connected thereto.

U-shaped channel 268 has legs 270 with openings 272 in both legs 270. Bushings 274 are positioned in openings 272, and shaft 70 passes therethrough. Drive shaft 70 is keyed or otherwise connected to horizontal input pulley 232. Fasteners 276 are inserted through openings 260 in first bracket 234, and securely affixed second bracket 236 to platform 50. Fasteners 278 extend through slots 246 in second bracket 236 and through fastener openings 256 in rear panel 250 of second bracket 236. Slots 246 and slot 258 allow drive pulley 220 and main input shaft 224 to move together so that tension may be applied to input belt 228 by the movement of vertical input pulley 226, which moves with transmission shaft 224. Transmission shaft 224 will be keyed or otherwise connected to vertical input pulley 226. A sleeve 279 may be disposed in openings 242 and 244 through which main input shaft 224 extends. The transmission of the current disclosure provides advantages over other transmissions. For example, the transmission gear box 42 allows pumping operations to quickly change over among different mechanical power inputs, and changeable pulley diameters can achieve consistent RPM among different input types. The input belt 228 can be tensioned without removing input drive pulleys 226 and 232. The diameter of external input shaft can be regionally specified to match common pulley hubs.

The input belt 228 may comprise a round belt that is geometrically constrained by pulley design and placement (plumb, parallel, level). The gearless operation of transmission gear box 42 reduces maintenance and wear, provides cost savings, decreases noise, and operates without lubrication, avoiding possible water contamination. The horizontal input pulley 232 is unidirectional to prevent damage and disruption to operation from backward rotation.

Horizontal input pulley 232 in one embodiment comprises an outer ring 280 that defines a central opening 281 and a groove 282 on the outer periphery thereof. Groove 282 is engaged by input belt 228. Central opening 281 defines a plurality of ratchet teeth 283 thereon. Outer ring 280 may be, for example, an injection molded outer ring. An inner hub 284 has a plurality of pawls 285. Rotation of outer ring 280 by input belt 228 will cause ratchet teeth 283 to engage pawls 285, thereby rotating drive shaft 70. It is impossible for horizontal input pulley 232 to rotate shaft 70 in the wrong direction. If by mistake the horizontal input pulley 232 were rotated in the wrong direction, no rotation of inner hub 284 would occur, since the ratchet teeth 283 would not engage the pawls 285. The inner hub 284 may be made from a low friction and resilient UHMW plastic. Upper and lower covers 286 and 288 are connected with fasteners extending through openings 289 in inner hub 284.

Water tank 44 has sealed upper and lower ports 290 and 292. A tapered lock ring 294 is threaded to an upper end of downspout 66 at lower port 292. Water tank 44 may have a cavity 293 in which a cup seal 296 and a mechanical water seal 298 are placed. The arrangement provides openings for the drive shaft 70 to pass therethrough, and also allows for incoming water to easily pass into water tank 44.

Downspout 66 may in one embodiment include a relief valve 300. Relief valve 300 is designed to prevent an over pressure condition in which the pump assembly 80 or other components can be damaged. In the event there is blockage or other conditions that create a pressure greater than the pump pressure specifications, the valve will open to provide pressure relief. The pump/water flow can be shut off, and the valve will close. Once the overpressure condition is remedied the pump assembly 80 can be restarted.

Relief valve 300 comprises a pipe saddle 302 disposed about a portion of downspout 66. A disc valve, which may be referred to as a flapper valve 304 is pivotally connected to lugs 306 on pipe saddle 302. Pipe saddle 302 has an outwardly extending socket 308 for engaging flapper valve 304. Socket 308 defines a generally cylindrical opening 310 with a magnetic cylinder 312 disposed therein. Flapper valve 304 has a flapper body 314 that is pivotably connected to lugs 306 and has a flapper head 316 for engaging socket 308. Flapper head 316 has a recess therein for receiving at least one, and in some cases a plurality of magnets 320. A lip 322 at a bottom of recess 318 prevents magnets 320 from passing therethrough. Magnets 320 may be securely pressed into recess 318 or may be secured by other means. A rubber gasket 324 may be positioned between pipe saddle 302 and downspout 66 on the side of the spout where the flapper valve 304 is located.

Prior to use, the magnets used can be set to match the pump pressure specifications. The pressure settings can be changed by adding/removing magnets or placing plastic shims between the magnet and/or the magnetic cylinder 312. When the pump assembly 80 is in use, the flapper valve 304 will disengage from the socket 308 if the pressure in the system exceeds a predefined pressure at which the pump assembly 80 may be damaged. Once pump assembly 80 is deactivated, flapper valve 304 will reengage the socket 308 and once any blockage is removed, the pump assembly 80 can be reactivated.

Figure 1B:
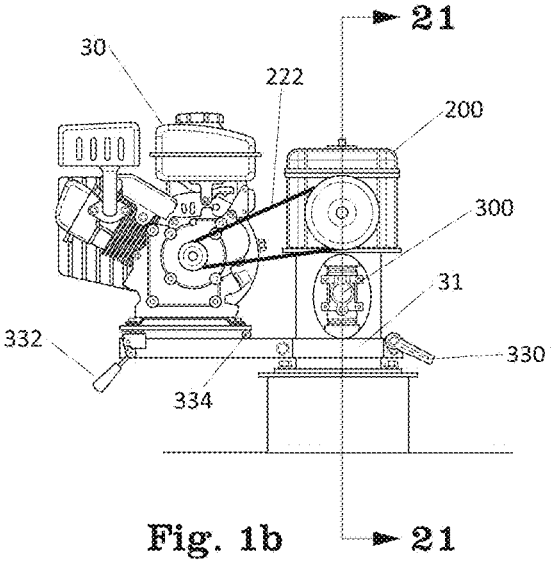
FIG. 1*b* shows the upper portion of the lift system with a gasoline engine in an operating position.
Figure 1C:
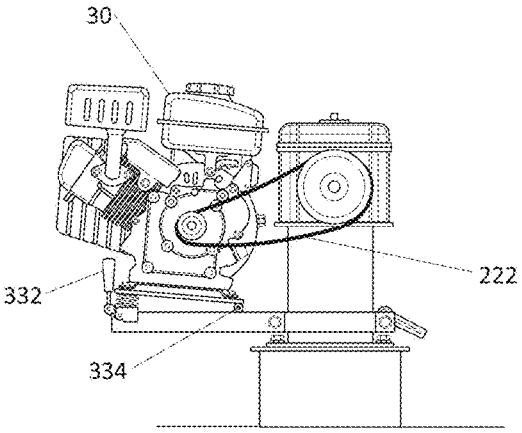
FIG. 1*c* shows the upper portion of the lift system with a gasoline engine prior to actuation of the transmission.
Figure 2:
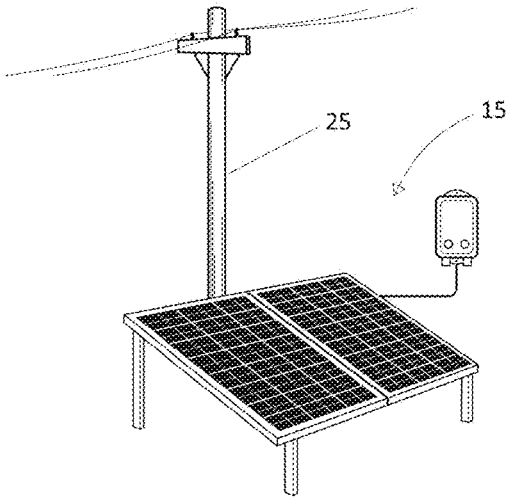
FIG. 2 is a schematic of a solar power source.
Figure 5:
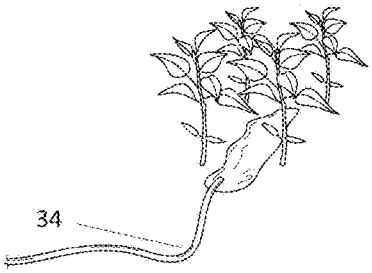
FIGS. 5-7 schematically show different output options for the fluid pumped with the lift system.
Figure 6:
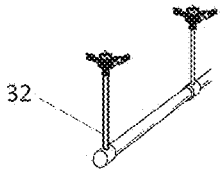
Figure 3:
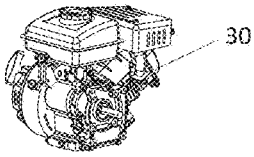
FIG. 3 is a schematic of a gasoline engine.
Figure 4:
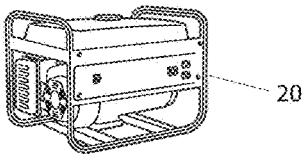
FIG. 4 is a schematic of a mobile generator.
Figure 7:
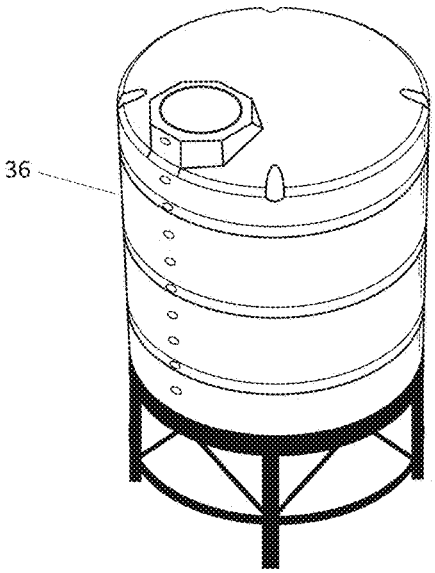
Figure 8:
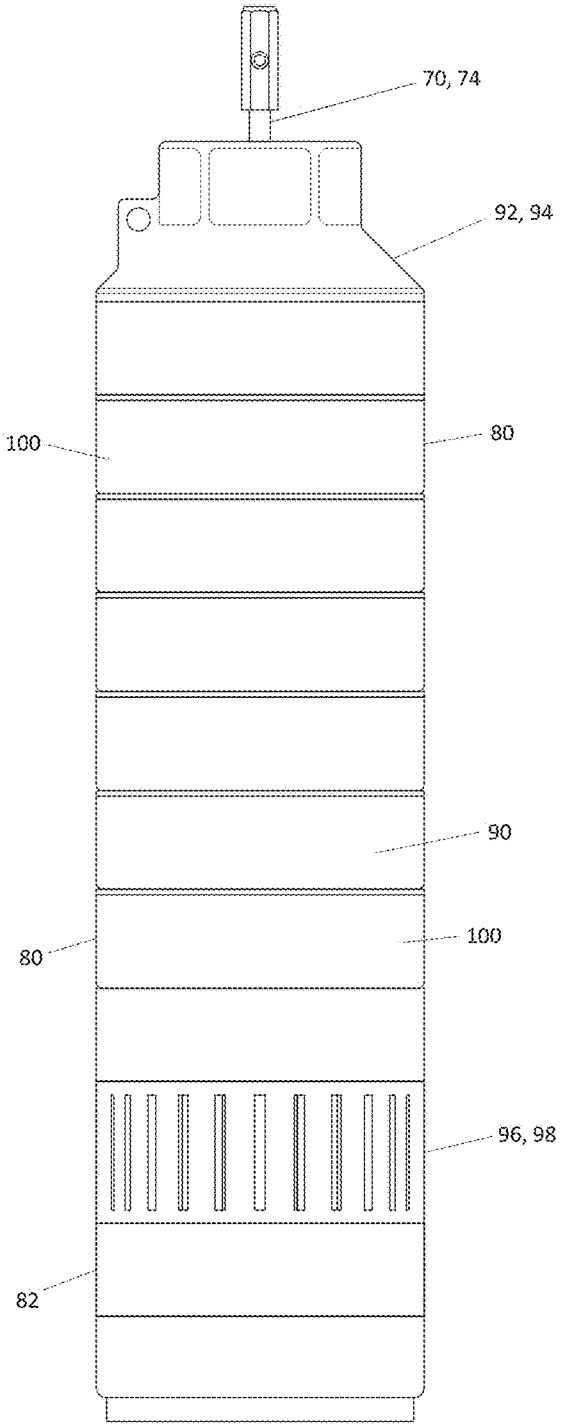
FIG. 8 is an elevation view of a pump assembly used in the lift system.
Figure 10:
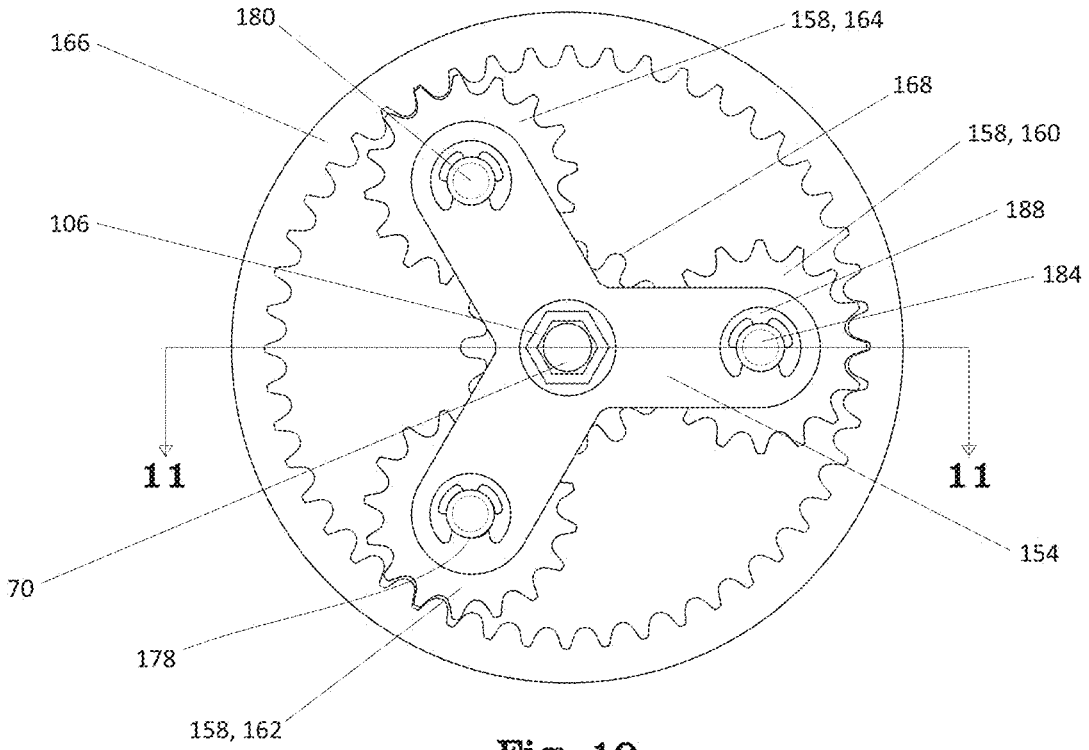
FIG. 10 is a top plan view of a gear assembly that may be used in the lift system.
Figure 11:
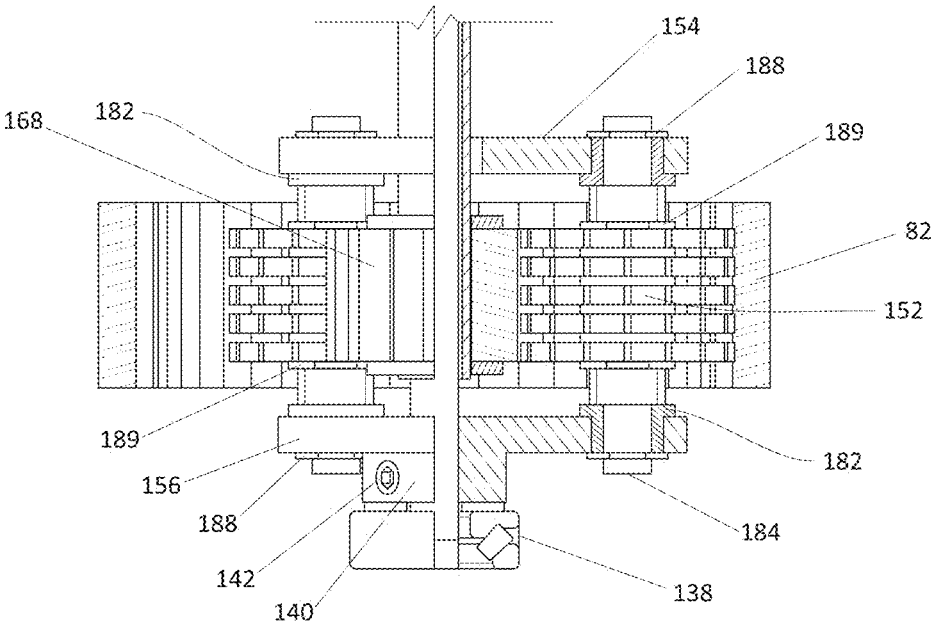
FIG. 11 is a partial cross section of the lower end of the pump assembly.
Figure 12:
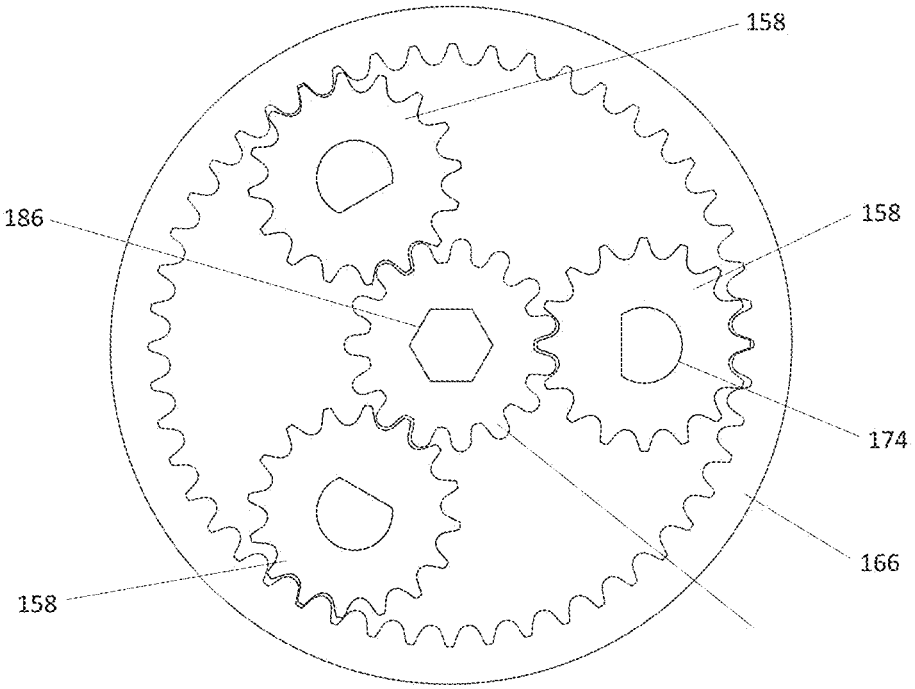
FIG. 12 is a top plan view of a planetary gear set.
Figure 13:
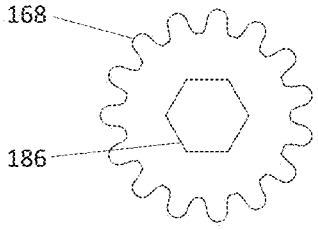
FIG. 13 is a top plan view of a sun gear.
Figure 15:
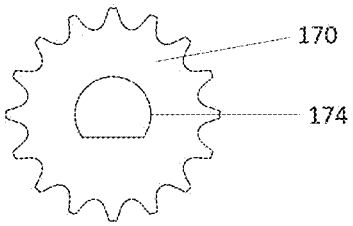
FIG. 15 is a top plan view of an individual sprocket used in a planet gear.
Figure 14:
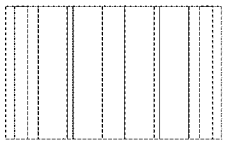
FIG. 14 is an elevation of a sun gear.
Figure 16:
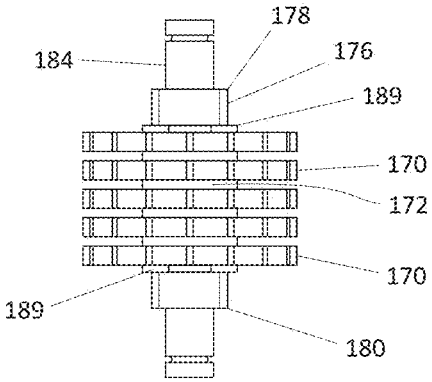
FIG. 16 is an elevation view of an assembled planet gear.
Figure 17:
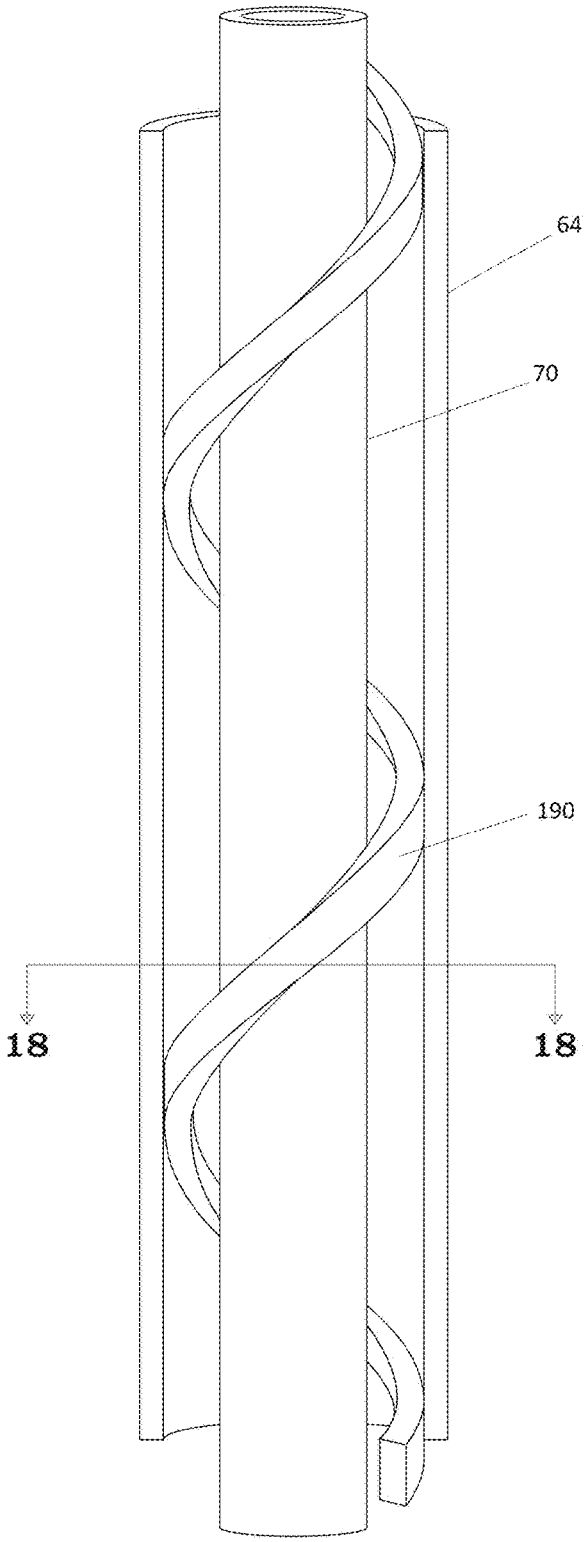
FIG. 17 is an embodiment showing a helical bearing disposed in the rising main of the lift system.
Figure 18:
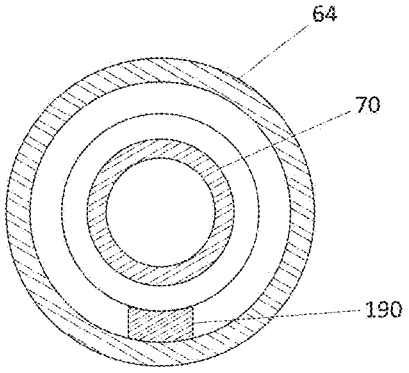
FIG. 18 is a cross section taken from lines 18-18 of FIG. 17.

In some embodiments, the pump is to be started with little or no tension in the drive belt 222. This is because a gasoline engine must spin freely to begin the internal combustion process in order to supply power. Any external load attached to the engine before starting will inhibit the engine from reaching a point where it can run autonomously. Once running, torque can be applied by tensioning the belt to begin the rotation of the pump. In the case of an electric motor, an external supply of electricity is being converted to mechanical energy which provides power for the rotation of the pump. If there is tension between the motor and drive pulley and attached to a load, an insufficient amount of electricity to begin rotation will damage the motor, and a sufficient amount of electricity to begin rotation will ramp up to maximum speed in a very short time interval resulting in over torquing transmission, drive shafts, and internal pump components resulting in breakage or fatigue. As shown in FIGS. 1*b* and 1*c*, lift system 5 has a movable base 31 that is movable vertically along transition pipe 48. A lever 330 may be used to resale and to tighten a securing band or to otherwise tighten and loosen so that the movable base 31 can be moved. A second lever 332 can be pivotally fixed to movable base 31 and in the position shown in FIG. 1*c* will pivot engine 30 about a hinge 334 to provide slack in drive belt 222. When moved to the position of FIG. 1*b*, drive belt 222 is tight, and drive pulley 220 is rotated by drive belt 222. The neutral position for movable base 31 is achieved by the lever position shown in FIG. 1*c* which allows the back edge of movable base 31 to be lifted upwards by a spring which slacks the drive belt 222 and prevents any energy input from reaching the main input shaft 224. The engaged position for movable base 31 is achieved by moving second lever 332 to position shown in FIG. 1*b* which counters the upward lift of the springs and locks movable base 31 in a rigid position and tensions drive belt 222.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. An apparatus for pumping fluid from a well comprising:
a drive mechanism;
a submersible pump positioned below the drive mechanism;
a gear assembly positioned in a gear box below the submersible pump;
an input shaft rotated by the drive mechanism and extending through the pump to the gear box; and
an output shaft connected to the gear assembly and extending therefrom into the pump, the output shaft rotated by the gear assembly and the pump being driven by the output shaft.

2. The apparatus of claim 1, the gear assembly comprising a speed increasing gear assembly.

3. The apparatus of claim 2, the gear assembly comprising a planetary gear assembly.

4. The apparatus of claim 1, the input shaft being rotatably disposed in the output shaft.

5. The apparatus of claim 4, wherein the input shaft and output shaft rotate in the same direction.

6. The apparatus of claim 4, the pump comprising a plurality of impellers, wherein the output shaft rotates the impellers.

7. The apparatus of claim 1, the drive mechanism comprising a motor selected from the group consisting of electric, gasoline, diesel and solar powered motors.

8. An apparatus for pumping fluid from a well comprising:
a motor;
a submersible pump;
a speed increasing gear assembly;
a rotatable output shaft connected to and extending from the gear assembly to the submersible pump; and
a rotatable input shaft connected to and extending from the motor through the pump to the gear assembly, the input shaft being disposed in the output shaft, wherein the input shaft rotates the gear assembly and the gear assembly rotates the output shaft.

9. The apparatus of claim 8, wherein the output shaft rotates at a higher speed than the input shaft.

10. The apparatus of claim 9, the input shaft and output shaft being rotated in the same direction.

11. The apparatus of claim 8 further comprising:
a rising main extending downwardly from a ground surface into the well, the input shaft being disposed in the rising main; and
a helical bearing disposed in the rising main and disposed about the input shaft for at least a portion of a length of the rising main.

12. The apparatus of claim 11, the helical bearing comprised of UHMW.

13. The apparatus of claim 8, the output shaft being a hollow hex-shaped output shaft.

14. The apparatus of claim 13, the gear assembly comprising a planetary gear set, wherein the input shaft rotates a planetary carrier of the planetary gear set and a sun gear of the planetary gear set rotates the output shaft.

15. A downhole pump assembly comprising:
a rising main extending from a ground surface into a well;
a motor mounted at the surface;
a transmission gear box connected to and actuated by the motor;
a downhole pump connected to the rising main;
a speed increasing gear assembly positioned below the pump;
an input shaft rotated by the transmission gear box and extending through the rising main and the pump assembly, and operably connected to the gear assembly; and
an output shaft rotatably connected to the gear assembly and operably connected to the downhole pump.

16. The downhole pump assembly of claim 15, at least a portion of the input shaft being disposed in the output shaft.

17. The downhole pump assembly of claim 16, wherein the input shaft and output shaft rotate at different speeds in the same direction.

18. The downhole pump assembly of claim 15, further comprising a longitudinally extending helical bearing disposed about the input shaft inside the rising main for at least a portion of the length of the rising main.

19. The downhole pump assembly of claim 15, the gear assembly comprising a planetary gear set, the input shaft rotatably connected to a planetary carrier of the planetary gear set, and the output shaft rotated by a sun gear of the planetary gear set.

20. The downhole pump assembly of claim 19, planet gears of the planetary gear set comprising a plurality of spaced apart sprockets.

* * * * *